US005349729A

United States Patent [19]

Brown

[11] Patent Number: 5,349,729

[45] Date of Patent: Sep. 27, 1994

[54] METHOD TO CONTROL DRAWING OF A PLURALITY OF SYNTHETIC YARNS

[75] Inventor: Robert S. Brown, Spartanburg, S.C.

[73] Assignee: Milliken Research Corporation, Spartanburg, S.C.

[21] Appl. No.: 100,426

[22] Filed: Aug. 2, 1993

[51] Int. Cl.[5] ..... D02J 1/22

[52] U.S. Cl. ..... 28/243; 28/241; 264/290.5

[58] Field of Search ..... 28/156, 167, 169, 178, 28/179, 180, 240, 241, 243, 246, 255, 283; 264/288.4, 288.8, 290.5

[56] References Cited

U.S. PATENT DOCUMENTS

| | | | |
|---|---|---|---|
| 3,153,106 | 10/1964 | Schlick | 264/78 |
| 3,302,385 | 2/1967 | Ruddell et al. . | |
| 3,323,165 | 6/1967 | Ruddell et al. . | |
| 3,394,429 | 7/1968 | Mottern et al. . | |
| 3,701,268 | 10/1972 | Trepton et al. | 28/179 X |
| 3,969,800 | 7/1976 | Baldini et al. | 28/71.3 |
| 4,389,364 | 6/1983 | Endo et al. | 28/243 X |
| 4,525,905 | 7/1985 | Bogucki-Land | 28/241 X |
| 4,592,119 | 6/1986 | Bauer et al. | 28/241 X |
| 4,611,410 | 9/1986 | Brossmer . | |
| 4,654,021 | 3/1987 | Herrington | 264/290.5 X |
| 4,669,159 | 6/1987 | Bogucki-Land | 28/241 X |
| 4,905,355 | 3/1990 | Bauer et al. . | |
| 5,080,952 | 1/1992 | Willbanks | 28/167 X |

FOREIGN PATENT DOCUMENTS

| | | | |
|---|---|---|---|
| 3523711 | 10/1976 | Fed. Rep. of Germany | 28/178 |
| 42-2614 | of 1967 | Japan | 28/246 |

*Primary Examiner*—Clifford D. Crowder
*Assistant Examiner*—John J. Calvert
*Attorney, Agent, or Firm*—Terry T. Moyer; Earle R. Marden

[57] ABSTRACT

Method and apparatus to selectively treat adjacent yarns in draw machine to provide different characteristics in the synthetic yarn being drawn and beamed. The yarn running between the feed rolls and draw rolls is selectively blown upwardly away from the heater to provide portions of heat set and unheat set drawn yarn.

7 Claims, 2 Drawing Sheets

METHOD TO CONTROL DRAWING OF A PLURALITY OF SYNTHETIC YARNS

This invention relates to a method to differently draw undrawn or partially oriented synthetic yarns such as nylon or polyester. In particular, individual yarns delivered from a creel are individually drawn so that adjacent yarns in a warp beam provide different effects in a fabric produced from such yarn.

In the past all the yarns drawn from a creel on a particular warp beam are drawn the same and, if it is desired to change the characteristics of such yarn, it is done prior to creeling or after it has been taken off the warp beam.

Therefore, it is an object of the invention to provide a warp beam of synthetic yarns on which adjacent yarns have been given different characteristics as they are drawn prior to warping.

Other objects and advantages of the novel method will become readily apparent as the specification proceeds to describe the invention with reference to the accompanying drawings, in which.

Figure 1:
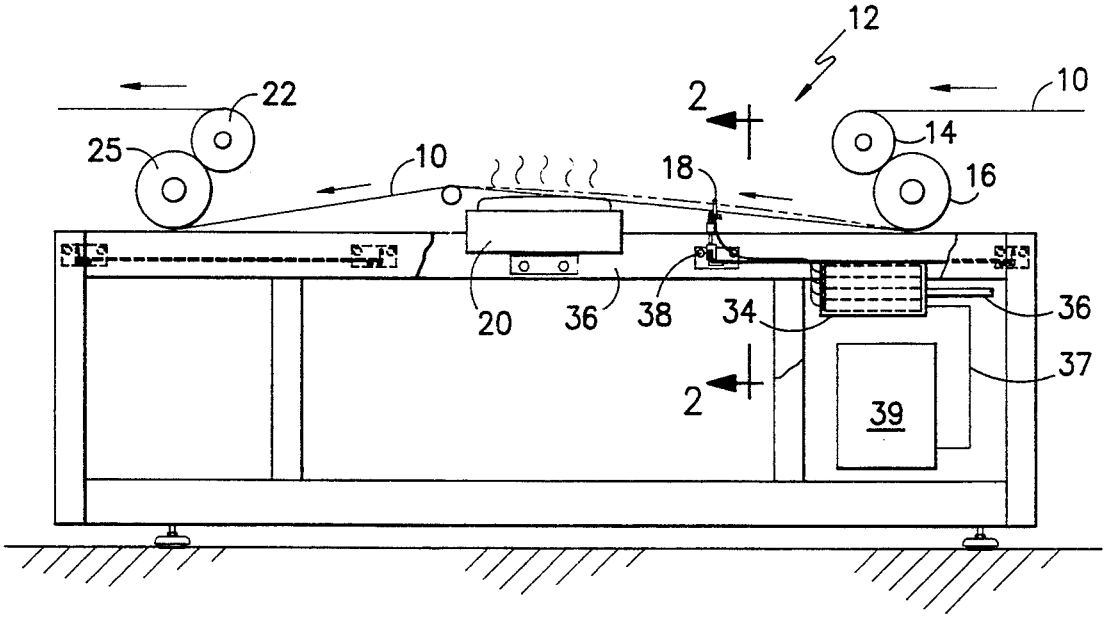
FIG. 1 is a side schematic view of the drawing apparatus used in the disclosed method.
Figure 2:
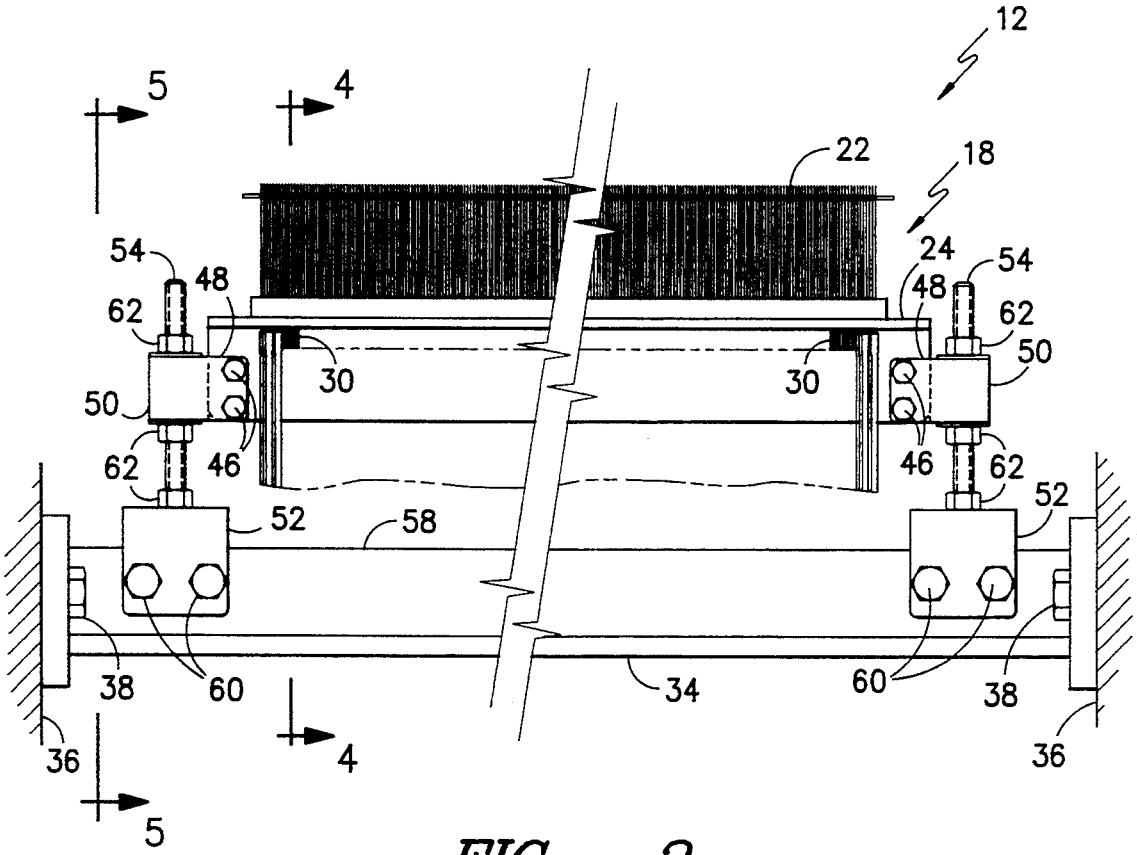
FIG. 2 is a cross-sectional taken on line 2—2 of FIG. 1.
Figure 3:
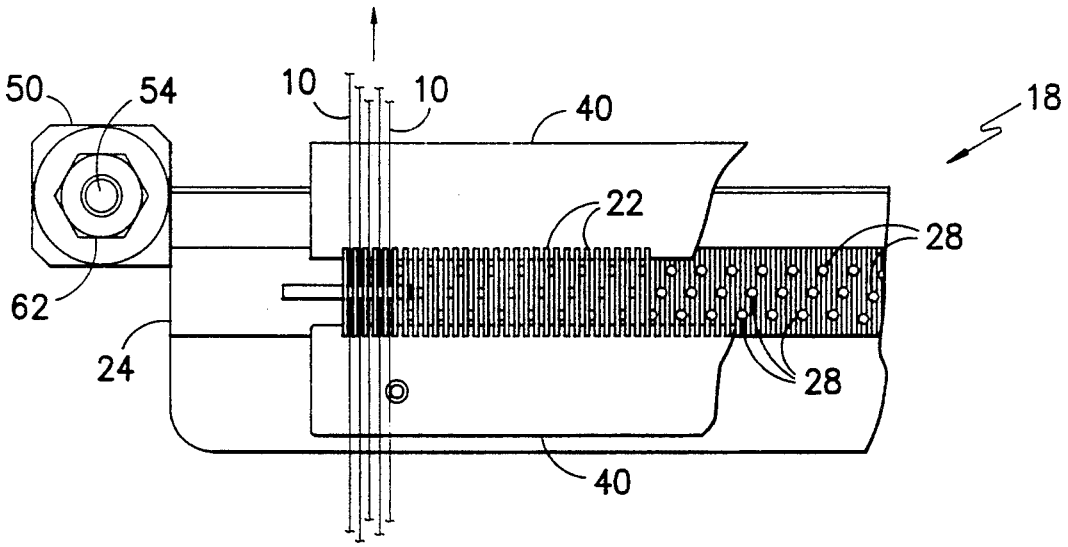
FIG. 3 is a top view of the reed area shown in FIG. 2.

Looking now to the drawings, the reference number 10 represents undrawn or partially oriented polyester or nylon synthetic filament yarns being supplied, each from a separate yarn on a creel (not shown). The yarns 10 are supplied to a draw machine 12 in which they are drawn and then delivered to a warp beam (not shown) for take up.

In the preferred form of the invention 170 denier, 100 filament polyester yarn is being supplied to the drive rolls 14 and 16 of the warp machine running at a speed of 71 yds/min. From the drive rolls 14, 16 the yarns pass through the reed 18 over the contact heater 20 to the draw rolls 22, 25 driven at a speed of 100 yds/min. which is greater than the speed of the rolls 14, 16 to draw the yarns 10 therebetween at a draw ratio of 1.4. The yarn can vary in denier from 40–300, polyester or nylon with 14–300 filaments. The entering roll speed can be in the range of 70–450 yds/min. while the exit roll speed can be in the range of 100 to 650 yds/min. If heat is being supplied to the heater 20 operating in the range of 100° C.–215° C. the yarns 10 in contact with the heater 20 will be drawn and heat set while yarns not in contact with the heater will be cold drawn and not heat set. This yarn can be subsequently heated (heater not shown) so that the cold drawn portion of the yarn is heat set (heater temperature 100° C. to 215° C.). This principle is used to provide selective treatment of adjacent yarns 10 so that when the yarns are used in a fabric, finishing treatment of the fabric will produce different physical characteristics in the fabric.

To selectively raise or lower particular yarns 10 off of the heater 20 the dents 22 of the reed 18 are mounted on the perforated portion 24 of an L-bar. In order to provide an opening 28 between each dent 22 of the reed 18, the openings 28 are staggered one from one another.

Projecting through the bottom of the plate 24 are tubes 30 to which are connected air lines 32 with an operating pressure in the range of 30–150 p.s.i., preferably 70 p.s.i. Air lines 32 are connected to an air manifold 34 supplied air by high pressure air line 36 from a source of air (not shown). The manifold 34 supplies air to each of the air lines 32 through a computer-controlled solenoid air valve (not shown) so that the computer software actuates in the computer 39 the desired solenoid valve via connection 37 to supply air to the desired opening for the pre-selected amount of time.

The reed 18 is mounted on the frame of the draw machine by an angle beam 34 extending across the width of the machine 12 and bolted to the sides 36 thereof by suitable bolts 38. Mounted on top of the plate 24 are reed locating members 40 with notches therein to accommodate the dents 22. The plate 24 has a downwardly projecting flange 44 bolted by suitable bolts 46 to the flange portion 48 of the rectangular or square support block 50. The block 50, as well as the U-shaped support member 52, has an opening therein to accommodate the threaded rod 54. The U-shaped support member 52 is mounted over the upright portion 58 of the angle beam 34 and secured in position by a bolt 60. To secure the reed 18 in the selected position the bolts 62 are screwed into position on the rod 54.

Figure 4:
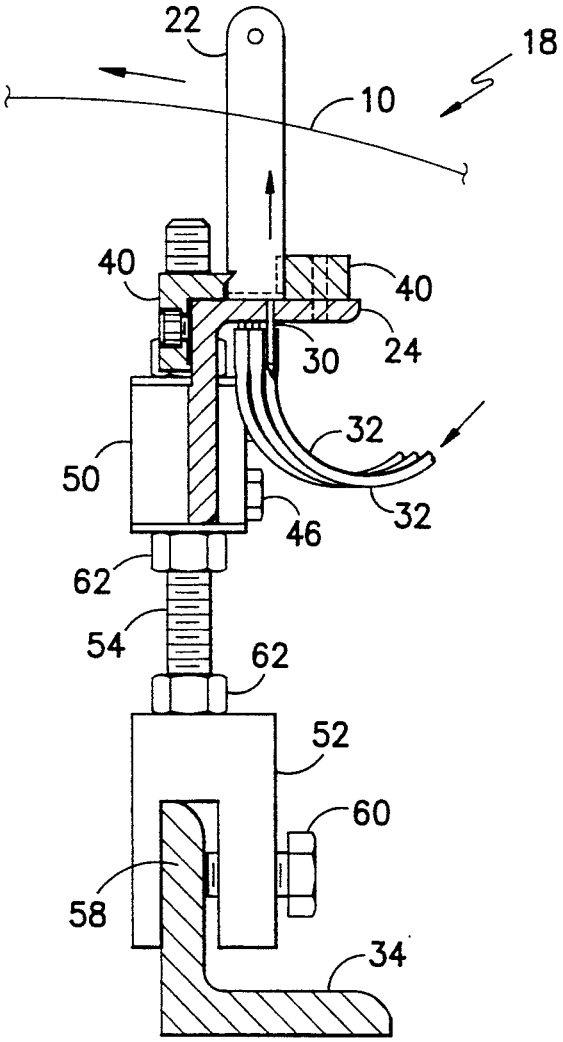
FIG. 4 is a view taken on line 4—4 of FIG. 2 with air being supplied to one of the yarns being drawn.
Figure 5:
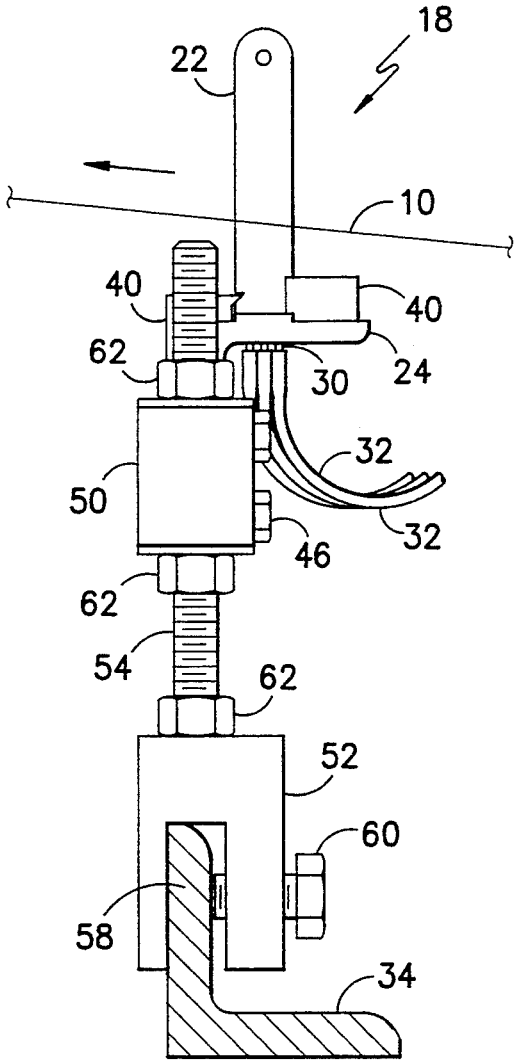
FIG. 5 is a view taken on line 5—5 of FIG. 2 showing the yarn in normally traveling position.

It can be seen that the herein-described apparatus provides a method in which pre-selected yarns for pre-selected times can be blown upwardly, as shown in FIG. 4, away from the heater 20 thereby being cold drawn and not heat set while portions of adjacent yarns are being heated and drawn in contact with the heater. Thusly, the drawn yarn, both heat set and unheat set, is taken up on a warp beam to be made into a fabric. When the fabric is finished during dyeing and/or scouring the yarn or portions thereof will react differently to the application of heat thereby providing either a random or patterned effect on the face of the fabric.

Although the preferred embodiment of the invention has been described fully in detail it is understood that changes may be made without departing from the scope or spirit of the invention and it is desired that the invention be limited only by the claims.

I claim:

1. A method to draw continuous filament synthetic yarn comprising the steps of: supplying a plurality of continuous filament synthetic yarns at one speed from a first set of rolls delivering the yarn to a second set of rolls driven at a second speed higher than the speed of the first set of rolls to draw the yarn, passing the yarns over a heater between the first set of rolls and the second set of rolls and periodically blowing selected yarns away from the surface of the heater to provide yarns with unset drawn portions thereon.

2. The method of claim 1 wherein the yarns are passed through a reed and the yarns are blown upwardly as they pass through the reed.

3. Machine to draw synthetic continuous filament yarn comprising: a first set of rolls driven at a first speed mounted on one end of the machine, a second set of rolls mounted on said machine downstream from said first set of rolls and driven at a second speed higher than the speed of said first set of rolls, a heater mounted on said machine between said first and second set of rolls in the path of travel of yarn from the first set of rolls to the second set of rolls, a reed upstream of said heater having dents to provide dent spaces therebetween for the passage of yarn between said dents, a source of air operably associated with said dent spaces to periodically blow air upwardly away from said heater and means to supply air to each of said sources of air.

4. The machine of claim 3 wherein a plate is mounted below said dents and has perforations therein between said dents, said source of air being supplied to each of said openings.

5. The machine of claim 4 wherein the openings between adjacent dent spaces are staggered in relation to the next adjacent dent spaces.

6. The machine of claim 5 wherein each opening in said plate is supplied air through an individual air line.

7. The machine of claim 6 wherein the supply of air in each air line is controlled by a computer.

* * * * *